United States Patent [19]

Nishikawa et al.

[11] 4,150,349

[45] Apr. 17, 1979

[54] SCREEN DRUM TYPE ELECTROGRAPHIC APPARATUS

[75] Inventors: Masaji Nishikawa, Hachioji; Eiichi Sato, Tama, both of Japan

[73] Assignee: Olympus Optical Co., Ltd., Tokyo, Japan

[21] Appl. No.: 793,370

[22] Filed: May 3, 1977

Related U.S. Application Data

[63] Continuation-in-part of Ser. No. 702,125, July 2, 1976, abandoned

[30] Foreign Application Priority Data

Jul. 10, 1975 [JP] Japan ..... 50-83925

[51] Int. Cl.[2] ..... G03G 15/18

[52] U.S. Cl. ..... 355/3 SC; 355/3 R

[58] Field of Search ..... 355/3 SC, 3 TE, 3 R; 96/1 R, 1 TE, 1 PC

[56] References Cited

U.S. PATENT DOCUMENTS

| | | | |
|---|---|---|---|
| 3,955,128 | 5/1976 | Wu et al. | 355/3 SC X |
| 3,985,432 | 10/1976 | Hou et al. | 355/3 SC |

*Primary Examiner*—L. T. Hix
*Assistant Examiner*—W. J. Brady
*Attorney, Agent, or Firm*—Haseltine, Lake & Waters

[57] ABSTRACT

A screen drum type electrographic apparatus which can alleviate widening of a dot constituting a picture image is disclosed. A ratio of a feeding speed of a record medium to a peripheral speed of a screen drum is selected to a range shown by a hatched region in FIG. 3 on the basis of theoretical calculation treatments illustrated in FIG. 2.

20 Claims, 11 Drawing Figures

Dot Obtained at A' Shown in Fig. 2

Dot Obtained at B' Shown in Fig. 2

Dot Obtained at that Posisition on Record Sheet Shown in Fig. 2 which is Symmetrically Opposite to B' with Respect to A'

SCREEN DRUM TYPE ELECTROGRAPHIC APPARATUS

This is a continuation-in-part of application Ser. No. 702,125 filed July 2, 1976, now abandoned.

This invention relates to a screen drum type electrographic apparatus, which comprises a photosensitive screen drum and forms a picture image on a record medium such as a record sheet fed along a rectilinear passage.

A technique of superimposing a photoconductive layer, an insulating layer, an electric conductive layer, etc. one upon the other and adhering these layers with each other to form a screen-shaped body, modulating a flow of ions by a difference between electric fields produced in or near meshes of the screen-shaped body by means of corona discharge, light image illumination, etc., and forming an electrostatic latent image on a dielectric record medium or selectively charging floating ink particles by means of a flow of ions so as to obtain a colored picture image on an ordinary sheet of paper, has been well known in the art.

In a conventional electrographic apparatus, it has been the common practice to use a drum-shaped photosensitive body, transfer a toner image from the drum-shaped photosensitive body onto an ordinary sheet of paper or transfer an electrostatic latent image from the drum-shaped photosensitive body onto an electrostatic record medium. In these measures, the record medium is fed along the drum in substantially close contact with the drum. As a result, the peripheral speed of the drum must be made equal to the feeding speed of the record medium. In addition, in these measures, that part of the drum-shaped photosensitive body from which the toner image or the electrostatic latent image is transferred onto the record sheet is limited to that range of the record medium which is in contact with the drum-shaped photosensitive body.

A screen drum type electrographic apparatus which comprises a photosensitive screen drum and forms a picture image on a record medium such as a record sheet fed along a rectilinear passage, has also been well known in the art.

Experimental tests effected on such screen drum type electrographic apparatus have yielded the result that in order to obtain a good picture image a corona charging width of a corona discharge device adapted to form a picture image on a record medium (hereinafter will be called a print corona discharge device), that is, a width of a flow of ions must be made extremely narrow. That is, if the corona charging width is wide, a dot constituting the picture image becomes widened, thereby remarkably degrading the resolution of the picture image.

On the contrary, if the corona charging width is narrow, the print speed must be made low, and as a result, it is impossible to provide a high speed recording apparatus. These problems which have been encountered with the conventional techniques are contrary to each other and hence it is very difficult to eliminate such problems.

Inventors' experimental tests have demonstrated that the corona charging width which can be defined within a corona ion current produced from a corona discharge device usable in practice without remarkably decreasing the corona ion current is at least a range between 20 mm and 25 mm. For this purpose, measures have been proposed to arrange an insulating member near an opening of a conductive corona shield of a corona discharge device or to not only arrange such insulating member but also apply to the conductive corona shield an electric potential which is intermediate between an electric potential applied to a corona discharge wire and ground potential, as described in U.S. Patent application Ser. No. 665,315, now U.S. Pat. No. 4,053,769.

In order to increase the corona ion current so as to increase the print speed, it is necessary to make the corona discharge device large in size and the corona charging width wide. In this case, if the peripheral speed of the screen drum is made equal to the feeding speed of the record medium, the dot becomes remarkably widened such that the resolution of the picture image is significantly degraded and that electrographic apparatus could not be used in practice. On the contrary, if the voltage applied to the corona discharge wire only is made high without making the corona discharge device large in size, the corona discharge device tends to produce a spark discharge, and as a result, it is difficult to operate the corona discharge device in a stable manner. As will be described later, in order to eliminate such problem, it is effective to select a ratio of the feeding speed of the record medium to the peripheral speed of the screen drum to a ratio of a segment of the record medium which is formed between two points located on the record medium and corresponding to a corona charging width to an arc drawn from that point on the screen drum which is the nearest to the record medium to that any arbitrary point on the screen drum which corresponds to the most outside edge of the corona charging width or to a ratio of the above mentioned segment to that part of the above mentioned arc which is obtained when such arc approaches to a center of the screen drum within the range of the corona charging width. But, even though the ratio of the feeding speed of the record medium to the peripheral speed of the screen drum is selected to the above mentioned value, if the corona charging width is made longer than a range between 25 mm and 30 mm by using a screen drum having a diameter within a usual range between 100 mm and 300 mm, there is a risk of the dot constituting the picture image being widened and displaced to such extent that hinders the electrographic apparatus from using in practice.

An object of the invention, therefore, is to provide a screen drum type electrographic apparatus which can effect a high speed printing operation with a largest possibly wide charging width maintained without degrading the resolution of the picture image.

Another object of the invention is to provide a screen drum type electrographic apparatus which can remarkably alleviate the widening of the dot by selecting a ratio of the feeding speed of the record medium to the peripheral speed of the screen drum in correspondence with the corona charging width.

A further object of the invention is to provide a screen drum type electrographic apparatus which has a wide corona charging width, which can effect a high speed printing operation and which alleviates the widening of the dot and hence improve the resolution of the picture image.

A still further object of the invention is to provide a screen drum type electrographic apparatus which is high in black concentration, which can alleviate the widening of the dot and hence improve the resolution of the picture image and which can effect a high speed printing operation.

Another object of the invention is to provide a screen drum type electrographic apparatus which can operate in a stable manner by applying a suitable voltage to a corona discharge device, which can effect a high speed printing operation and which can improve the resolution of the picture image.

A feature of the invention is the provision of a screen drum type electrographic apparatus comprising a screen drum rotatable at a constant speed, a flat-shaped record medium opposed to said screen drum, both said record medium and said screen drum being travelled at a constant speed, said screen drum forming thereon with an electrostatic latent image for modulating a flow of ions to form a picture image on said record medium, characterized by selecting a ratio of the feeding speed of said record medium to the peripheral speed of said screen drum to a value within a range between the maximum value and the minimum value of a ratio of $$\frac{\overline{A'B'}}{\overline{AB}}$$

where A, A' are points on those points on said screen drum and said record medium which are the nearest with each other, B is that point on said screen drum which is arbitrarily selected within the corona charging width and B' is that point on said record medium which corresponds to said point B and is connected thereto by electric lines of force.

In carrying out the invention, the feeding speed V of the record medium may approximately be calculated and given by $$v(1+\frac{d}{2R}) \leqq V \leqq v\{(1+\frac{d}{2R})+(\frac{2R+d}{24R})\theta_0^2\}$$

where R is a radius of the screen drum, d is the shortest distance between the screen drum and the record medium, V is a peripheral speed of the screen drum and $2\theta_0$ is a center angle formed by a width of the flow of ions diverging from a rotational center of the screen drum.

The invention will now be described in greater detail with reference to the accompanying drawings, wherein.

Figure 1:
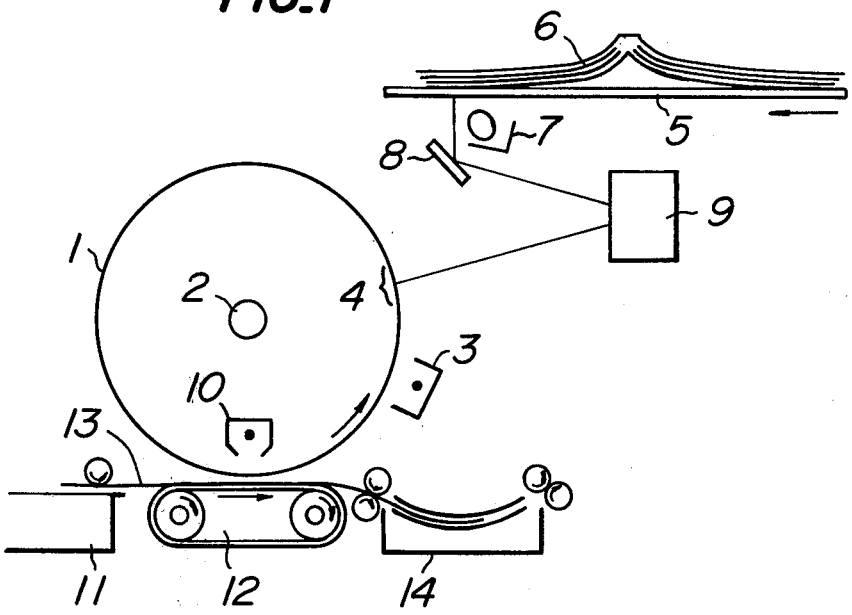
FIG. 1 is a diagrammatic view showing one embodiment of a screen drum type electrographic apparatus according to the invention.

Referring to FIG. 1 showing one embodiment of the screen drum type electrographic apparatus according to the invention, a screen drum 1 consists of a photoconductive layer, an insulating layer and an electric conductive layer which are superimposed one upon the other and formed into a cylindrical screen-shaped body. The screen drum 1 is rotatably mounted on a shaft 2 and rotated about the shaft 2 at a constant speed in a counterclockwise direction as shown by an arrow. Along the outer periphery of the screen drum 1 is arranged a first corona discharge device 3 which serves to uniformly charge the screen drum 1. On the screen drum 1 is further projected a manuscript image at its region 4 where a light image is illuminated.

In order to project the manuscript image onto the region 4, a manuscript 6 such as a printed matter is disposed on a carriage 5 which is movable in a horizontal direction and illuminated by a light source 7. A light reflected by the manuscript 6 is projected through a mirror 8 and a projection lens 9 onto the region 4. The uniform charge on the screen drum 1 is discharged in response to the light image projected onto the region 4 to produce an electrostatic latent image of the manuscript image on the screen drum 1. The screen drum 1 is further rotated and becomes opposed to a record medium 13 fed from a record medium supply tank 11 in synchronism with the drum 1 by means of an endless belt conveyor 12 on the one hand and also opposed to a second print corona discharge device 10 on the other hand. A flow of ions directed from the print corona discharge device 10 through meshes of the screen drum 1 toward the record medium 13 is modulated by the electrostatic latent image produced on the screen drum to form a corresponding latent image on the record medium 13.

This record medium 13 is fed to a developing tank 14 where the electrostatic latent image on the record medium is developed into a visual picture image.

The screen drum 1 further continues its rotation and is uniformly charged again by the first corona discharge device 3. The above mentioned operations are repeated to successively form visual picture images on the record medium 13.

In such screen drum type electrographic apparatus, the surface of the screen drum 1 bearing the electrostatic latent image travels along an arcuate passage, while record medium travels along a rectilinear passage. As a result, when the record medium 13 passes through the print region, electric charge dots formed on the record medium 13 become widened and hence the resolution of the picture image is degraded.

Such widening phenomenon of the electric charge dots will now be described with reference to FIG. 2 which diagrammatically illustrates the screen drum 1 and the record medium 13 in an enlarged scale. Let the peripheral speed of the screen drum 1 be v and assume that the record medium 13 is fed along a rectilinear passage at the same speed v. The flow of ions passed through the screen drum 1 travels along an arcuate passage which crosses at right angles with both the screen drum 1 and the record medium 13. This fact can be proved by solving Poisson's equation and by using a theory of conformal representation. That is, in FIG. 2, the flow of ions passing through any arbitrary point B on the screen drum 1 travels along an arc $\widehat{BB'}$ having a radius O'B extending from a point O' where a tangent drawn at the point B crosses with the record medium 13. As a result, the dimension of the widened electric charge dot formed on the record medium 13 is equal to an amount given by subtracting a real travelling distance $\widehat{AB}$ of the record medium 13 from a distance $\overline{A'B'}$. This amount will be called an amount of smear $\delta$ and given by $$\delta = \overline{A'B'} - \widehat{AB}$$

In order to reduce the widened dot, that is, the amount of smear $\delta$ so as to improve the resolution of the picture image, the print region, that is, the charging width of the print corona discharge device 10 may be made narrow. The use of such measure, however, provides the important disadvantage that the charging amount on the record medium 13 becomes insufficiently small so that both the rotating speed of the screen drum 1 and the feeding speed of the record medium 13 must be lowered and hence the recording speed becomes low.

In order to increase the charging amount on the record medium 13 without lowering both the rotating speed of the screen drum 1 and the feeding speed of the record medium 13, if a high voltage which does not correspond with the corona discharge device is applied thereto, the corona discharge device tends to easily produce a spark discharge, thereby rendering it impossible to operate the electrographic apparatus in a stable manner.

In order to obviate such disadvantage, it might be considered to feed the record medium 13 along an arcuate passage which is concentric with the screen drum 1 instead of feeding it along the rectilinear passage at a speed of (R+d/R) times higher than the speed of the screen drum 1 where R is a radius of the screen drum 1 and d is the shortest distance between the screen drum 1 and the record medium 13. Such measure, however, makes mechanisms for feeding and guiding the record medium 13 complex in construction and hence is not suitable for practical use.

It might also be considered to guide the record medium 13 along an arcuate passage which is symmetrical with respect to the screen drum 1 at the same speed as the speed of the screen drum 1. In this case also, the apparatus becomes complex in construction and large in size.

As seen from the above, the screen drum type electrographic apparatus designed to feed the record medium 13 along the arcuate passage becomes complex in construction and is not suitable for practical use.

In accordance with the invention, the record medium 13 is fed along a rectilinear passage at least at a recording region as shown in FIG. 1 and the feeding speed of the record medium 13 is so related to the peripheral speed of the screen drum 1 that the charging width of the print corona discharge device is widened without degrading the resolution of the picture image and that a high speed recording can be effected.

The invention will now be described with reference to the result yielded from inventors' experimental tests and theoretical observations.

Figure 2:
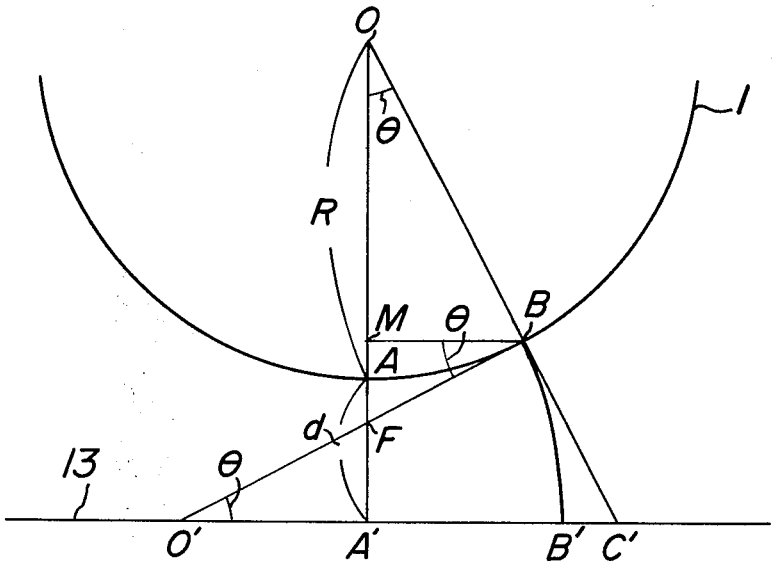
FIG. 2 is a diagrammatic view showing a part of the apparatus shown in FIG. 1 in an enlarged scale and illustrating a principle of the invention.

As shown in FIG. 2, the center of the screen drum 1 is denoted by 0, its radius by R, the shortest distance between the screen drum 1 and the record medium 13 by d, the center positions of the screen drum 1 and the record medium by A and A', respectively, that point on the record medium 13 which corresponds to that point B on the screen drum 1 and which is located on the record medium when the screen drum 1 is rotated by $\theta$ by B' and any other points necessary for illustration are denoted by letters as shown in FIG. 2.

Between the screen drum 1 and a field electrode (not shown) for supporting the record medium 13 is applied an electrical field and the electric lines of force established by the electrical field are perpendicular to both the screen drum surface and the record medium surface. Thus, the electric lines of force are formed at the center part along the straight line AA' and also formed along an arc $\widehat{BB'}$ having a center O' where a tangent drawn at the point B of the drum 1 crosses with the record medium surface. The flow of ions travels along these electric lines of force.

The segment $\overline{A'B'}$ shown in FIG. 2 will now be obtained by the following calculation treatment.

$$\overline{A'B'} = \overline{O'B'} - \overline{O'A'} = \overline{O'B} - \overline{O'A'} \tag{1}$$

$$\overline{O'B}\tan\theta = \overline{BC} = \overline{OC} - \overline{OB} = \frac{R+d}{\cos\theta} - R$$

Thus, $$\overline{O'B'} = \overline{O'B} = \frac{\{\frac{(R+d)}{\cos\theta} - R\}}{\tan\theta} \tag{2}$$

Also, $$\overline{O'A'}\tan\theta = \overline{A'F}$$

$$\begin{aligned}\overline{A'F} &= \overline{A'M} - \overline{MF}\\ &= [(R+d) - R\cos\theta] - \overline{MB}\tan\theta\\ &= (\overline{OA'} - \overline{OM}) - \overline{MF}\\ &= (R+d) - R\cos\theta - R\sin\theta\tan\theta\end{aligned}$$

Accordingly, $$\overline{O'A'} = \frac{\{(R+d) - R\cos\theta - R\sin\theta\tan\theta\}}{\tan\theta} \tag{3}$$

From the above equations (1), (2) and (3), $$\begin{aligned}\overline{A'B'} &= \overline{O'B'} - \overline{O'A'}\\ &= \frac{\{\frac{(R+d)}{\cos\theta} - R - (R+d) + R\cos\theta + R\sin\theta\tan\theta\}}{\tan\theta}\\ &= (2R+d)\tan\frac{\theta}{2}\end{aligned} \tag{4}$$

This equation (4) can be approximated into the following equation (5).

$$\begin{aligned}\overline{A'B'} &\approx R(1+\frac{d}{2R})\theta + (\frac{2R+d}{24})\theta^3 =\\ &R\theta(1+\frac{d}{2R}) + R\theta(\frac{2R+d}{24R})\theta^2\end{aligned} \tag{5}$$

The object of obtaining the relation between the arc $\widehat{AB} = R\theta$ and the corresponding segment $\overline{A'B'}$ on the record medium 13 in accordance with the electric field drawing method shown in FIG. 2 is based on the inventors' recognition that the dot widening effect produced on the record medium 13 can be alleviated by selecting a ratio of the feeding speed of the record medium 13 to the peripheral speed of the screen drum 1 to a ratio of the segment $\overline{A'B'}$ to the arc $\widehat{AB}$.

The meaning of the above equation (5) will now be described in greater detail with reference to FIG. 3.

Figure 3:
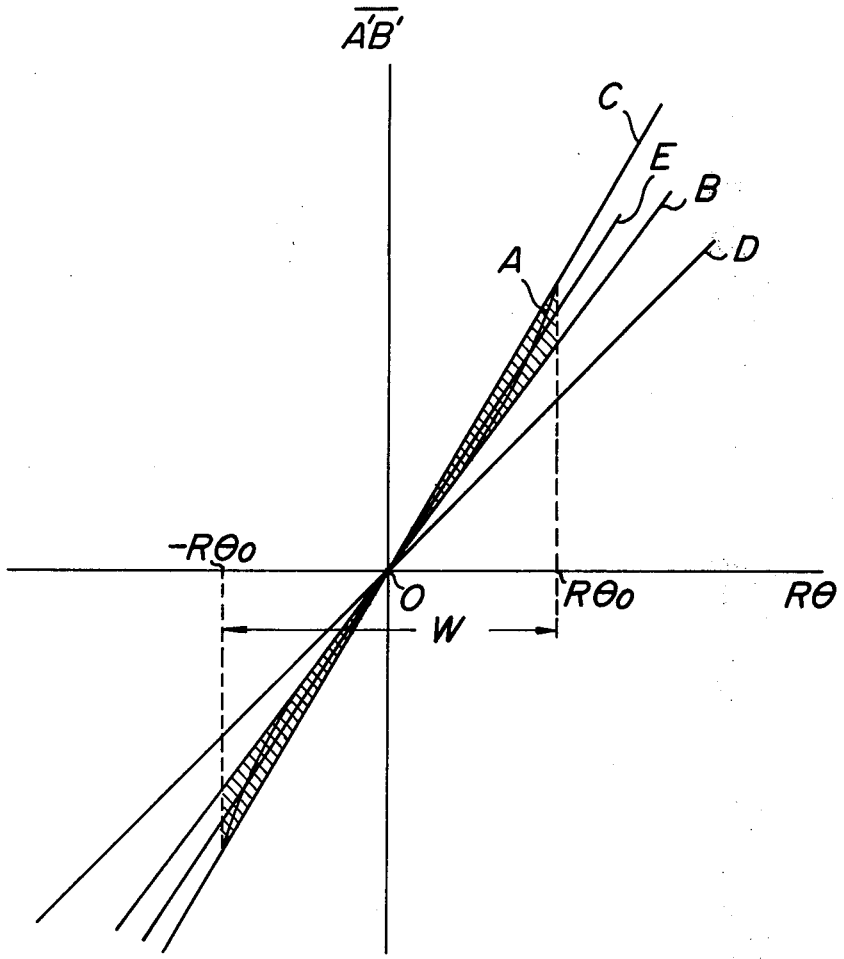
FIG. 3 is a graph showing a width W defined by the invention.

If $R\theta$ is plotted on abscissa and $\overline{A'B'}$ is plotted on ordinate, the above equation (5) is shown by a curve A in FIG. 3.

Now considering any one dot, if the feeding speed of the record medium 13 is not made constant but changed as shown by the curve A in FIG. 3, the widening of the dot could be completely eliminated. In practice, however, a number of dots are printed on the record medium at the same time, so that the other dots become widened. As a result, the record medium is obliged to be fed at a constant speed.

In the equation (5), a straight line represented by the first term of the right side thereof, that is, $$\overline{A'B'} = R\theta(1 + \frac{d}{2R})$$

is shown by a straight line B in FIG. 3. In addition, let that value of $\theta$ which corresponds to a given corona charging width W be $\theta_0$, $\overline{A'B'}$ defined by the equation (5) satisfies the following condition.

$$\overline{A'B'} \leqq R\theta(1 + \frac{d}{2R}) + R\theta(\frac{2R + d}{24R})\theta_0^2 \; (0 \leqq \theta \leqq \theta_0)$$

While a straight line expressed by an equation $$\overline{A'B'} = R\theta(1 + \frac{d}{2R}) + R\theta(\frac{2R + d}{24R})\theta_0^2$$

is shown by a straight line C in FIG. 3. As can be understood from FIG. 3, if the feeding speed of record medium is so selected that a straight line $\overline{A'B'}$ defined by the selected speed lies within a hatched range sandwiched between the straight lines B and C, the widening of the dot becomes extremely small, and as a result, even when a sufficiently wide corona charging width W is used, a picture image having a high resolution can be formed on the record medium and the recording operation can be effected at a high speed. In FIG. 3, a straight line D shows $\overline{A'B'}$ obtained when the record medium 13 is fed at a speed which is the same as the peripheral speed of the drum 1.

From the above analysis it is derived that the feeding speed of the record medium 13 can be determined in such a manner that during a time period in which the screen drum 1 rotates over a small angle $\theta$, the record medium travels over a distance $\overline{A'B'}$ which is given by the following inequality.

$$R\theta(1 + \frac{d}{2R}) \leqq \overline{A'B'} \leqq R\theta\{(1 + \frac{d}{2R}) + \frac{2R + d}{24R}\theta_0^2\}$$

Now let the feeding speed of the record medium 13 be V and let the peripheral speed of the drum 1 be v, $\overline{A'B'} = Vt$ and $R\theta = vt$ can be obtained. Then the above inequality can be expressed by the following inequality (6).

$$v(1 + \frac{d}{2R}) \leqq V \leqq v\{(1 + \frac{d}{2R}) + (\frac{2R + d}{24R})\theta_0^2\} \quad (6)$$

Thus, by selecting the feeding speed V of the record medium 13 within a range defined by the above equation (6), it is possible to alleviate the widening of the electric charge dot.

It is obvious from the above equation (6) that the feeding speed V of the record medium 13 may be made $$(1 + \frac{d}{2R})$$

times higher than the peripheral speed v of the screen drum 1. In the equation (5), the second term $$R\theta(\frac{2R + d}{24R})\theta^2$$

shows that the widening of the dot could not be obviated if the record medium 13 is fed at the constant speed as mentioned above.

Even when the use is made of the invention, if the screen drum 1 is rotated at a constant speed and the record medium 13 is also fed at a constant speed, the widening of the dot due to the second term $$R\theta(\frac{2R + d}{24R})\theta^2$$

of the equation (5) could not completely be obviated. The invention, however, is capable of alleviating the widening of the dot to such a degree that the widening of the dot can be left out of consideration in practice.

Figure 4:
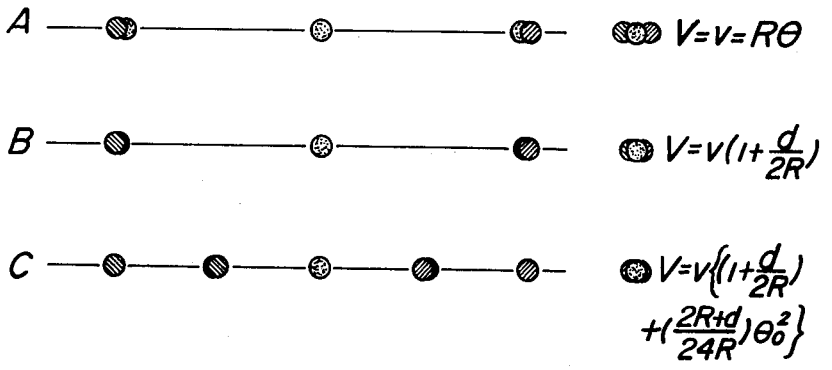
FIG. 4 is a diagrammatic view illustrating the relation between the feeding speed V of a record medium and the widening of the dot.

In FIG. 4 is graphically illustrated the relation between the feeding speed V of the record medium 13 and the widening of the dot. In FIG. 4, a letter A shows a case in which V=v, that is, the record medium 13 is fed at the same speed as the peripheral speed of the screen drum 1. In this case, the dot becomes considerably widened. In FIG. 4, a letter B shows another case in which $$V = (1 + \frac{d}{2R})v.$$

In this case, the widening of the dot becomes relatively small. In FIG. 4, a letter C shows a further case in which V is selected to a value given by $$V = v\{(1 + \frac{d}{2R}) + (\frac{2R + d}{24R})\theta_0^2\}$$

In this case, the widening of the dot becomes further reduced.

As seen also from FIG. 4, the invention is capable of alleviating the widening of dot by selecting the feeding speed V of the record medium 13 to a range between the minimum value of a ratio of the length of the section $\overline{A'B'}$ on the record medium to the arc $\widehat{AB}$ on the screen drum, that is, $$(1 + \frac{d}{2R})$$

and the maximum value of said ratio, that is, $$(1 + \frac{d}{2R}) + (\frac{2R + d}{24R})\theta_0^2,$$

in other words by selecting the feeding speed V of the record medium 13 to a range given by $$v(1 + \frac{d}{2R}) \leqq V \leqq v\{(1 + \frac{d}{2R}) + (\frac{2R + d}{24R})\theta_0^2\}$$

as shown in the above equation (6).

In the above mentioned range of V, that value of V at which the widening of dot becomes minimum, i.e. an optimum value, will now be found. Let the feeding speed V of the record medium 13 be assumed k times higher than the peripheral speed v of the screen drum 1. That is, let V be V=kv, then the point A' shown in FIG. 2 is moved kvt after an instantaneous time t. That is, $$kvt = kv\frac{\theta}{\dot{\theta}} = kv\frac{\theta}{v/R} = kR\theta$$

In this case, the amount of smear δ is given by $$\delta = \overline{A'B'} - kvt = R\theta + \frac{d}{2}\theta + \left(\frac{2R+d}{24}\right)\theta^3 - kR\theta \tag{7}$$

$$= R\theta\left(1 + \frac{d}{2R} - k\right) + \left(\frac{2R+d}{24}\right)\theta^3$$

In the above equation (7), k may take any arbitrary value. If k is selected to a suitable value, that amount of smear which is maximum at an angle corresponding a corona charging width $2\theta_0$ of the corona discharge device can be reduced.

If the value of k is selected to a numerical value given by $$k = 1 + \frac{d}{2R} + \left(\frac{2R+d}{24}\right)\theta_x^2 \tag{8}$$

the equation (7) becomes $$\delta(\theta) = \frac{2R+d}{24}(\theta_x^2\theta - \theta^3) \tag{9}$$

That amount of smear defined by the equation (9) which will take the maximum value in the corona discharging width $2\theta_0$ of the corona discharge device will now be found.

In this case, consider a first case $\theta_x^2 \leqq 0$ and a second case $\theta_x^2 > 0$.

As seen from the equation (9), in both the first and second cases, $\delta(\theta)$ passes through an original point of $\theta=0$ and is point symmetrical with respect to the original point. As a result, if $\delta(\theta)$ which takes a maximum value in a positive region with respect to $\theta$ is obtained and then its absolute value is obtained as the amount of smear, it is possible to calculate from a value which is two times the above absolute value the widening of dot produced in the corona charging width as a whole. The amount of smear in both the first and second cases will now be calculated.

(1) The first case $\theta_x^2 \leqq 0$.

Figure 5A:
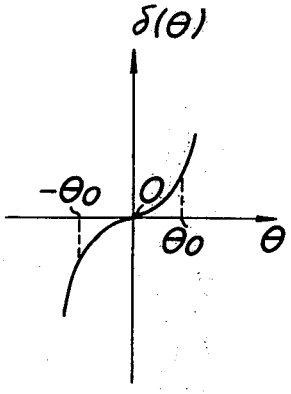
FIGS. 5A, 5B, 6A, 6B, 6C and 7 are graphs illustrating methods of obtaining the minimum amount of smear.

In this case, $\delta(\theta)$ is shown by a curve in FIG. 5A. As seen from this curve, the amount of smear becomes maximum when $\theta=\theta_0$.

Thus, $$|\delta(\theta_x)_{max}| = \frac{2R+d}{24}|\theta_x^2\theta_0 - \theta_0^3| \tag{10}$$

$$= \frac{2R+d}{24}(-\theta_x^2\theta_0 + \theta_0^3)$$

(2) The second case $\theta_x^2 > 0$.

Figure 5B:
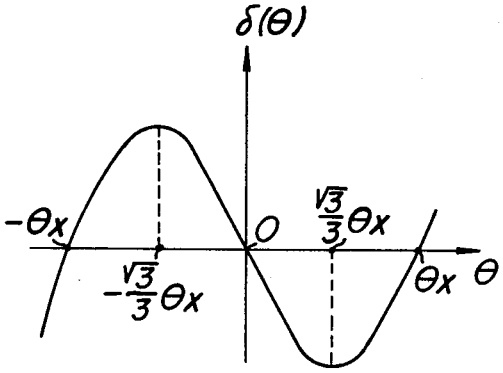

In this case, $\delta(\theta)$ is shown by a curve in FIG. 5B which crosses with the $\theta$ axis at $\theta_x$, 0 and $-\theta_x$. As seen from this curve, the maximum amount of smear is obtained when $$\theta = \frac{\sqrt{3}}{3}\theta_x \text{ and } \theta = -\frac{\sqrt{3}}{3}\theta_x.$$

Figure 6A:
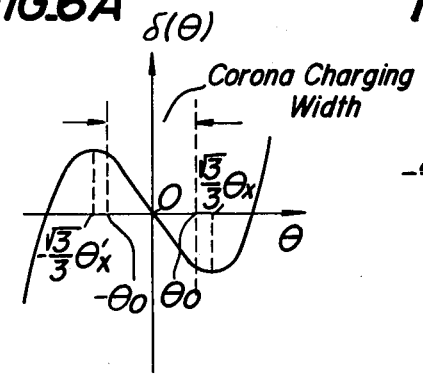
Figure 6B:
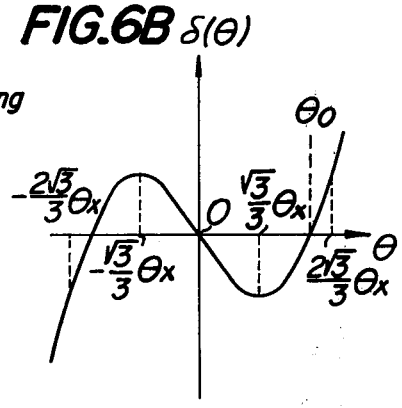
Figure 6C:
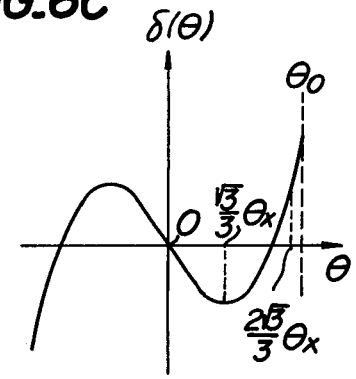

The corona charging width $2\theta_0$ of the corona discharging device is determined by three methods illustrated by FIGS. 6A, 6B and 6C, respectively.

The method illustrated by FIG. 6A

As seen from FIG. 6A, $$0 < \theta_0 < \frac{\theta_x}{\sqrt{3}}, \text{ that is, } \sqrt{3}\,\theta_0 < \theta_x.$$

When $\theta=\theta_0$, the amount of smear becomes maximum and the amount of smear is given by $$|\delta(\theta_x)_{max}| = \frac{2R+d}{24}(\theta_x^2\theta_0 - \theta_0^3) \tag{11}$$

The method illustrated by FIG. 6B

As seen from FIG. 6B, $$\frac{\theta_x}{\sqrt{3}} \leqq \theta_0 < \frac{2\sqrt{3}}{3}\theta_x, \text{ that is,}$$

$$\frac{\sqrt{3}}{2}\theta_0 < \theta_x \leqq \sqrt{3}\,\theta_0.$$

When $$\theta = \frac{\sqrt{3}}{3}\theta_x,$$

the amount of smear becomes maximum and the amount of smear is given by $$|\delta(\frac{\sqrt{3}}{3}\theta_x)_{max}| = \frac{\sqrt{3}(2R+d)}{108}\theta_x^2 \tag{12}$$

The method illustrated by FIG. 6C

As seen from FIG. 6C, $$\frac{2\sqrt{3}}{3}\theta_x \leqq \theta_0, \text{ that is, } \theta_x \leqq \frac{\sqrt{3}}{2}\theta_0.$$

The maximum value of smear is given by $$|\delta(\theta_0)_{max}| = \frac{2R+d}{24}(\theta_0^3 - \theta_x^2\theta_0) \tag{13}$$

Figure 7:
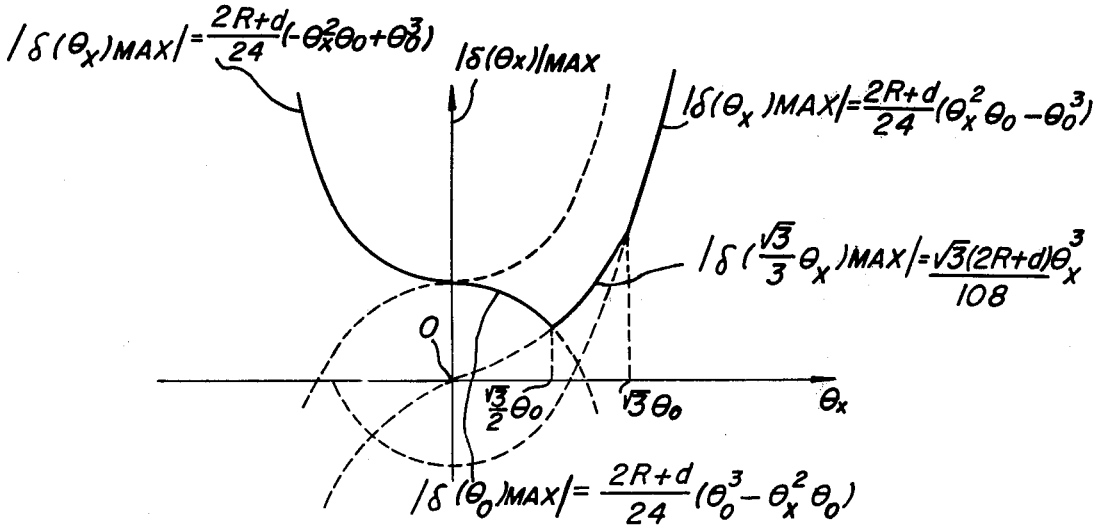

The amount of smear $|\delta(\theta_x)|_{max}$, i.e. $|\delta_{max}|$ obtained by the above mentioned cases (1) and (2) in function of the value of k, that is, $\theta_x$ is shown in FIG. 7. As seen from FIG. 7, the amount of smear becomes minimum when $\theta_x$ is selected to such value that $$\theta_x = \frac{\sqrt{3}}{2}\theta_0$$

is satisfied. In this case, the straight line $\overline{A'B'}$ shown in FIG. 2 is shown by a straight line E in FIG. 3.

The above described calculation treatments and the meaning thereof will now be described.

Let the ratio k of the feeding speed of the record medium to the peripheral speed of the screen drum be $$k = 1 + \frac{d}{2R} + \left(\frac{2R+d}{24R}\right)\theta_x^2,$$

the amount of smear δ is given by $$\delta = -\frac{2R+d}{24}(\theta_x^2\theta - \theta^3).$$

This amount of smear δ is developed from the right side, second term of the equation (5) which is given by $$\overline{A'B'} = R\theta\left(1 + \frac{d}{2R}\right) + R\theta\left(\frac{2R+d}{24R}\right)\theta^2.$$

That value of $\theta_x$ which gives the minimum value of δ relates to $(\theta_x^2\theta-\theta^3)$ only of the above equation of $$\delta = -\frac{2R+d}{24}(\theta_x^2\theta - \theta^3),$$

but does not relate to (2R+d)/.24 The calculation treatment of obtaining $\theta_x$ which makes δ minimum when the corona charging width is given by $2\theta_0$ has been described in the development of obtaining the minimum value of $\theta_x^2\theta_0-\theta_0^3$. If the resulting value $\theta_x=(\sqrt{3}/2)\theta_0$ is substituted into the equation of k, then k is given by $$k = 1 + \frac{d}{2R} + \frac{2R+d}{24R}\left(\frac{\sqrt{3}}{2}\theta_0\right)^2.$$

If this equation of k is compared with the equation (5), i.e.

$$\overline{A'B'} \approx R\theta\left(1 + \frac{d}{2R}\right) + R\theta\left(\frac{2R+d}{24R}\right)\theta^2,$$

the reasons why the ratio of the feeding speed of the record medium to the peripheral speed of the screen drum is selected to the ratio $$\frac{\overline{A'B'}}{\widehat{AB}}$$

are understood, $\overline{A'B'}$ being a segment on the record medium and $\widehat{AB}$ being an arc at a position of $\theta=(\sqrt{3}/2)\theta_0$, i.e. at a position of $\sqrt{3}/2$ of $\theta_0$ corresponding to the corona charging width. In other words, the right side, second term of the equation (5) giving the segment $\overline{A'B'}$ monotonously increases, so that the fact that k is determined on the basis of the position $\sqrt{3}/2$ of the corona charging width $\theta_0$ is understood that the speed ratio k is determined such that the direction of producing the smear becomes opposite before and after $\theta=(\sqrt{3}/2)\theta_0$ and that the amount of smear becomes equal with each other.

In the speed ratio k determined as above described, let, for example, R=90 mm, d=5 mm and $\theta_0=0.11$ (corona charging width), the amount of smear $\delta_{max}\approx 0.0026$ mm. That is, the amount of smear at one side becomes on the order of 2.6μ and 2δ becomes 5.2μ. Such amount of smear is smaller than 1/20 of the distances between the centers of adjacent meshes of 0.127 mm in 200 mesh screen, so that such amount of smear can be neglected.

In the above equation (5), even though V=v, if the corona charging width W is extremely narrow and θ is sufficiently small, $$\frac{d}{2R}\cdot R\theta \text{ and } \frac{2R+d}{24}\theta^3$$

become so small that a good picture image is obtained as described above. Assuming R=90 mm, d=5 mm and the use of a 200 mesh screen drum having a distance between centers of adjacent meshes of 0.127 mm, the limit charging width W which causes the dot to widen by the same width as the distance between centers of adjacent meshes of 0.127 mm is obtained by calculation to be about 4.9 mm when V=v.

As in the case of the present invention, if V is selected to $$V = v\left(1 + \frac{d}{2R}\right),$$

W becomes about 37 mm and hence it is possible to make the corona charging width W 7.6 times wider than the above mentioned case of V=v. As a result, the recording speed can be made higher.

In addition, if the limit widening of the dot is made ½ of 0.127 mm (the dot size is 0.19 mm), W becomes about 2.5 mm for V=v. On the contrary, if V is selected to $$V = v\left(1 + \frac{d}{2R}\right),$$

w becomes about 29 mm which is 12 times larger than 2.5 mm.

Further, if the limit widening of the dot is made ¼ of 0.127 mm (the dot size is 0.16 mm), the corona charging width W becomes about 1.25 mm for V=v. On the contrary, if V is selected to $$V = v\left(1 + \frac{d}{2R}\right),$$

W becomes about 23.1 mm which is about 18 times larger than 1.25 mm.

The relation between the charging width W of the print corona discharge device 10 and the distance P between the centers of adjacent meshes of the screen drum 1 will now be described.

From the above equation (7), the amount of smear δ is given by $$\delta = R\theta\left(1 + \frac{d}{2R} - k\right) + \frac{(2R+d)}{24}\theta^3.$$

If $k = 1 + \frac{d}{2R}$, the amount of smear is given by $$\delta = \frac{2R+d}{24}\theta^3$$

This equation is of cubic one with respect to θ and the corona charging width is symmetrical with respect to the straight line OA′ shown in FIG. 2, so that the practical amount of smear becomes 2 times larger than the above mentioned value of δ and given by $$\delta = \left(\frac{2R+d}{12}\right)\theta^3 = \frac{2R+d}{12R^3}(R\theta)^3 \qquad (14)$$

$R\theta = W/2$ and hence the equation (14) can be written by $$\delta = \frac{2R+d}{12R^3}\left(\frac{W}{2}\right)^3 = \frac{2R+d}{12R^3}\cdot\frac{W^3}{8}$$

The amount of smear $\delta$ must be smaller than the distance P between the centers of adjacent meshes of the screen drum 1, so that $$\delta = \frac{2R+d}{12R^3}\cdot\frac{W^3}{8} < P \qquad (15)$$

From this equation (15)

$$W \leqq 2R\left(\frac{12P}{2R+d}\right)^{\frac{1}{3}} \qquad (16)$$

In order to improve the quality of the picture image, if $\delta = \frac{1}{2}P$ and $\delta = \frac{1}{4}P$, respectively, then $$W \leqq 2R\left(\frac{6P}{2R+d}\right)^{\frac{1}{3}} \qquad (16)'$$

and $$W \leqq 2R\left(\frac{3P}{2R+d}\right)^{\frac{1}{3}} \qquad (16)'',$$

respectively.

Under the conditions that the radius of the screen drum R is 102 mm, the distance d between the screen drum and the record medium is 4.8 mm and the distance P between the centers of adjacent meshes of the screen is $127\mu = 0.127$ mm, the corona charging widths W corresponding to the allowable smear $\delta$ for $\delta = p$, $\delta = \frac{1}{2}p$ and $\delta = \frac{1}{4}p$ can be calculated as follows.

$W \leqq 39.6$ mm for $\delta = p = 0.127$ mm, $W \leqq 31.5$ mm for $\delta = \frac{1}{2}p = 0.063$ mm, and $W \leqq 25.0$ mm for $\delta = \frac{1}{4}p = 0.032$ mm.

In the case of copying diagrams, photographs, etc. the resolution required for which is not severe, it is possible to select W to a range between 30 mm and 40 mm. In the case of copying printed matters mainly consisting of documents, whose resolution must be made high, it is desirous to select W to a value which is smaller than 25 mm. In order to obtain a picture image having a high resolution, it is effective to make the corona charging width narrow. But, as described above, when the corona discharge current is determined to a required value, the corona charging width has its lower limit of a range between 20 mm and 25 mm. As a result, the above mentioned calculation treatments are not sufficient to provide an electrographic apparatus for obtaining a picture image having a high resolution at a high speed.

The corona charging width allowable when a ratio of the feeding speed of the record medium to the peripheral speed of the screen drum is selected to a ratio of the segment $\overline{A'B'}$ on the record medium to the arc $\widehat{AB}$ on the screen drum at $\sqrt{3}/2$ position on the corona charging width $\theta_o$, that is, the corona charging width allowable under the optimum speed conditions will now be calculated.

In the above equations (12) and (13), if $\theta_x = (\sqrt{3/2})\theta_0$, then the allowable $\delta$ under the optimum speed conditions is obtained. That is, $$\delta = \frac{(2R+d)}{96}\theta_0^3.$$

If the calculation treatments which are the same as in the case of deriving the equations (14), (15) and (16) are effected, then $$W \leqq 4R\left(\frac{6\delta}{2R+d}\right)^{\frac{1}{3}} \qquad (17)$$

In the above equation (17), if $\delta = p$, $\delta = \frac{1}{2}p$ and $\delta = \frac{1}{4}p$, then $$W \leqq 4R\left(\frac{6p}{2R+d}\right)^{\frac{1}{3}} \qquad (17)'$$

$$W \leqq 4R\left(\frac{3p}{2R+d}\right)^{\frac{1}{3}} \qquad (17)''$$

$$W \leqq 4R\left(\frac{1.5p}{2R+d}\right)^{\frac{1}{3}} \qquad (17)'''$$

Under the conditions that R = 102 mm, d = 4.8 mm and p = 0.127 mm which are the same as in the above described case of $k = 1 + d/2R$, the corona charging widths corresponding to the allowable smears $\delta$ for $\delta = p$, $\delta = \frac{1}{2}p$ and $\delta = \frac{1}{4}p$ can be calculated as follows.

$W \leqq 62.9$ mm for $\delta = p = 0.127$ mm, $W \leqq 50.0$ mm for $\delta = \frac{1}{2}p = 0.063$ mm, and $W \leqq 39.7$ mm for $\delta = \frac{1}{4}p = 0.032$ mm.

As seen from the above, under the same conditions for $\delta$, the allowable corona charging width can be made 1.6 times wider than that when $k = 1 + (d/2R)$. This shows that the invention is capable of eliminating problems encountered with the prior art techniques.

The diameter of the screen drum allowable when an electrographic apparatus is designed to make it small in size, operative in a high speed and produce a picture image having a high resolution will now be described.

As described above, the corona charging width W is designed to 20 mm which is suitably used in practice without decreasing the corona discharge current. If $k = 1 + d/2R$, $\delta = \frac{1}{4}p$ and a screen of 200 mesh whose p is 0.127 mm are used, then from the equation (16)'' W is given by $$W \leqq 2R\left(\frac{3p}{2R+d}\right)^{\frac{1}{3}}$$

So, if $R > d$, then $$W \leqq 2R\left(\frac{3p}{2R}\right)^{\frac{1}{3}}.$$

This equation can be rewritten into $$R \geqq \sqrt{\frac{W^3}{12p}}.$$

If W = 20 mm and p = 0.127 mm are substituted into the above equation, then $2R \geqq 145$ mm.

The diameter of the screen drum when the apparatus is designed under the optimum condition can be calculated from the equation (17)'''. In this case, the allowable minimum diameter of the screen drum is given by calculation $$2R = 72.5 \text{ mm.}$$

As a result, even though the diameter 2R of the screen drum is smaller than about 150 mm, the application of the optimum condition provides the advantage that the diameter of the screen drum can be made more smaller and that the corona charging width can be made wider than 20 mm.

Figure 8:
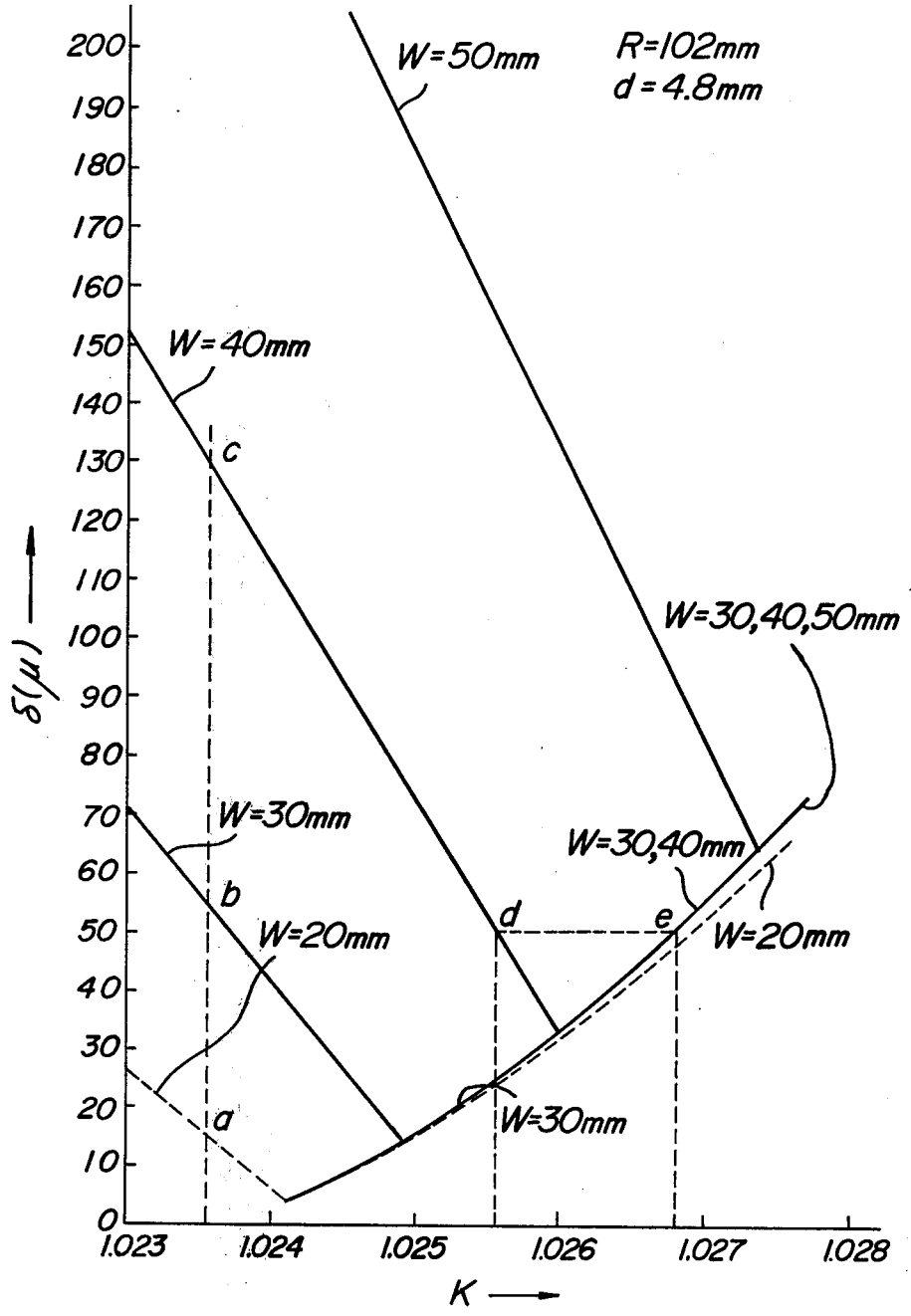
FIG. 8 is a graph illustrating relations between the amount of smear δ and the ratio k of the feeding speed of the record medium and the peripheral speed of the screen drum by taking the corona charging width W as parameters under conditions that a radius R of the screen drum is 102 mm and the shortest distance d between the screen drum and the record medium is 4.8 mm.

In FIG. 8 is shown the amount of smear $\delta$ is $\mu$ in function of k which is equal to a ratio of the feeding speed V of the record medium to the peripheral speed v of the screen drum under conditions that radius R of the screen drum is 102 mm and the distance d between the screen drum and record medium is 4.8 mm, the corona charging width W in mm being taken as parameter.

In FIG. 8, if k is given by $$k = (1 + \frac{d}{2R}) = (1 + \frac{4.8}{204}) = 1.02353$$

and the corona charging width W is 20 mm, then $\delta$ is $15\mu$ as shown by a point a. Similarly, if W is 30 mm, then $\delta$ is $54\mu$ as shown by a point b. If W is 40 mm, then $\delta$ is $130\mu$ as shown by a point c.

In the case of designing the apparatus such that the corona charging width is 40 mm and $\delta$ is smaller than $50\mu$, points d and e where a line representing $\delta = 50\mu$ crosses with a line and cruve representing W=40 mm are obtained and then values of k corresponding to these points d and e are read out which are k=1.0255 and k=1.0268, respectively. In this case, the apparatus can be designed and manufactured with an allowable error given by $$1.0255 < k < 1.0268.$$

EXAMPLE 1

In the present example, use was made of a photosensitive screen of 200 meshes. A screen drum type electrographic apparatus shown in FIG. 1 was designed and manufactured under such conditions that the radius R of the screen drum is 102 mm, the shortest distance d between the screen drum and the record medium is 4.8 mm and the corona charging width W is 20 mm. the ratio k of the feeding speed V of the record medium to the peripheral speed v of the screen drum was selected to k=1.024 for the purpose of alleviating the widening of dot $\delta$ to the order of $5\mu$. The apparatus was designed to obtain 10 copies having a maximum length of 17 inches per minute. Detailed investigations on the picture image thus copied have shown that the dots are not widened at all, that a local widening of dot is slightly produced due to unstable feeding of the record medium, and that the apparatus is excellent for practical use. Use was made of a developing liquid, but the concentration of the black portion on the picture image was on the order of D=1.2 and a beautiful picture image without producing fog thereon was obtained.

EXAMPLE 2

In the apparatus described above with reference to the Example 1, the corona discharge device was altered such that the corona charging width W is 30 mm and a ratio k of the feeding speed V of the record medium to the peripheral speed v of the screen drum is 1.025. Under such conditions, the widening of dot was $15\mu$. The apparatus was designed to obtain 12 copies having a maximum length of 17 inches per minute. Detailed investigations on the picture image thus copied have shown that the dots are not widened in substantially similar extent to that of Example 1, that a local widening of dot is slightly increased due to unstable feeding of the record medium and that the concentration of the picture image is sufficiently high so that the apparatus is excellent for practical use in the same manner as that of the Example 1.

EXAMPLE 3

In the apparatus described above with reference to the example 1, use was made of a corona discharge device which can provide a corona charging width of 40 mm. A diameter of a roller for driving the belt conveyor for feeding the record medium was altered such that a ratio k of the feeding speed V to the peripheral speed v of the screen drum becomes 1.026. As seen from FIG. 8, the widening of dot was $33\mu$. The apparatus was designed to obtain 15 copies having a maximum length of 17 inches per minute. Detailed investigations on the picture image thus copied have shown that the dots are slightly widened and that a resolution of 5 to 5.5 lines/mm on the basis of the resolution chart is possible. That is, a picture image inclusive of minute letters was obtained with practically no problem involved. As to the concentration of the picture image, a sufficiently high concentration thereof was obtained irrespective of the increase of the copying speed. This is because of the fact that in the case of widening the charging width of the corona discharge device, a sufficiently high voltage is applied thereto, and as a result, the corona discharge current is increased so as to make the concentration of the picture image high.

EXAMPLE 4

In the apparatus described above with reference to the Example 1, use was made of a corona discharge device comprising 2 corona discharge wires arranged parallel with each other so as to obtain a corona charging width W of 50 mm. In the present example, the ratio k of the feeding speed V of the record medium to the peripheral speed v of the screen drum was selected to 1.027. As seen from FIG. 8, the widening of the dot is $64\mu$.

Slightly small widening of dot on the recorded picture was perceived by naked eyes and the resolution for the extremely small letters was slightly degraded. But, the resolution for the documents in general involved no troubles at all. The resolution for the photographs and pictures was sufficiently high as in the cases of the Examples 1 to 4.

All of the apparatuses described with reference to the Examples 1 to 4 can reproduce the photographs, particularly half-tone thereof, in an extremely smooth manner which is far superior to that of the conventional apparatus.

What is claimed is:

1. A screen drum type electrographic apparatus comprising a drum type screen photosensitive body rotatable at a constant speed, and a flat-shaped record medium opposed to said screen photosensitive body and fed along a rectilinear passage at a constant speed, whereby a flow of ions is modulated by an electrostatic latent image produced on said screen photosensitive body to form a picture image on said record medium, the improvement comprising in that when A is a position on a passage of the screen drum surface, which position is nearest to the record medium passage, B is a position on the screen drum passage which is angularly displaced from the position A by an angle $\theta_0$ corresponding to a half of a center angle formed by a width of the flow of ions viewing from a rotational center of the screen drum, A' and B' are positions on the record medium passage at which positions the lines of electric force passing through the positions A and B on the screen drum passage, respectively, cross with the record medium passage, R is a radius of the screen drum and d is a distance between the positions A and A', a feeding speed V of the record medium with respect to a peripheral speed v of the screen drum is set to a value within a range which is defined on the one hand by a value of $v(1+(d/2R)$ and on the other hand by a value at which a dot formed on a point of the record medium at the position A' by means of the flow of ions passing through a point on the screen drum at the position A reaches the position B' after the screen drum has rotated by the angle $\theta_0$.

2. The apparatus according to claim 1, wherein the feeding speed V of said record medium is selected within a range given by $$v(1+\frac{d}{2R}) < V < v\{(1+\frac{d}{2R}) + (\frac{2R+d}{24R})\theta_0^2\}.$$

3. The apparatus according to claim 1, wherein a corona charging width is so determined that a widening of dot formed on said record medium is narrower than a distance between centers of adjacent meshes in said screen.

4. The apparatus according to claim 1, wherein a corona charging width is so determined that a widening of dot formed on said record medium is smaller than $\frac{1}{2}$ times a distance between centers of adjacent meshes in said screen.

5. The apparatus according to claim 1, wherein a corona charging width is so determined that a widening of dot formed on said record medium is smaller than $\frac{1}{4}$ times a distance between centers of adjacent meshes in said screen.

6. The apparatus according to claim 2, wherein a corona charging width W is given by $$W \leqq 2R(\frac{12p}{2R+d})^{\frac{1}{3}}$$

where p is a distance between centers of adjacent meshes in said screen.

7. The apparatus according to claim 2, wherein a corona charging width W is given by $$W \leqq 2R(\frac{6p}{2R+d})^{\frac{1}{3}}$$

where p is a distance between centers of adjacent meshes in said screen.

8. The apparatus according to claim 2, wherein a corona charging width W is given by $$W \leqq 2R(\frac{3p}{2R+d})^{\frac{1}{3}}$$

where p is a distance between centers of adjacent meshes in said screen.

9. A screen drum type electrographic apparatus comprising a drum type screen photosensitive body rotatable at a constant speed, and a flat-shaped record medium opposed to said photosensitive body and fed along a rectilinear passage at a constant speed, whereby a flow of ions is modulated by an electrostatic latent image produced on said screen photosensitive body to form a picture image on said record medium, the improvement comprising in that when A is a position on a passage of the screen drum surface, which position is nearest to the record medium passage, A' is a position on the record medium passage, at which position a line of electric force passing through the position A crosses with the record medium passage and $\theta_0$ is an angle corresponding to a half of a center angle formed by a width of the flow of ions diverging from a rotational center of the screen drum, a feeding speed of the record medium with respect to a peripheral speed of the screen drum is set to such a value that a dot formed on a point of the record medium at the position A' by means of the flow of ions passing through a point on the screen drum at the position A reaches a position on the record medium passage at which the line of electric force passing through said point on the screen drum crosses with the record medium passage after the screen drum has rotated by an angle of $(\sqrt{3}/2)\theta_0$.

10. The apparatus according to claim 9, wherein said corona charging with width W is determined to a range given by $$W \leqq 4R(\frac{6p}{2R+d})^{\frac{1}{3}}$$

where R is a radius of said screen drum, p is a distance between centers of adjacent meshes in said screen and d is the shortest distance between said screen drum and said record medium.

11. The apparatus according to claim 9, wherein said corona charging width W is determined to a range given by $$W \leqq 4R(\frac{3p}{2R+d})^{\frac{1}{3}}$$

where R is a radius of said screen drum, p is a distance between centers of adjacent meshes in said screen and d is the shortest distance between said screen drum and said record medium.

12. The apparatus according to claim 9, wherein said corona charging width W is determined to a range given by $$W \leqq 4R(\frac{1.5p}{2R+d})^{\frac{1}{3}}$$

where R is a radius of said screen drum, p is a distance between centers of adjacent meshes in said screen and d is the shortest distance between said screen drum and said record medium.

13. The apparatus according to claim 9, wherein said corona charging width W in mm is determined to a range given by $$20 \leqq W \leqq 4R\left(\frac{1.5p}{2R + d}\right)^{\frac{1}{3}}$$

where R is a radius of said screen drum, p is a distance between centers of adjacent meshes in said screen and $\alpha$ is the shortest distance between said screen drum and said record medium.

14. The apparatus according to claim 9, wherein said corona charging width W in mm is determined to a range given by $$25 \leqq W \leqq 4R\left(\frac{1.5p}{2R + d}\right)^{\frac{1}{3}}$$

where R is a radius of said screen drum, p is a distance between centers of adjacent meshes in said screen and d is the shortest distance between said screen drum and said record medium.

15. The apparatus according to claim 9, wherein said charging width W is determined to be at least 20 mm.

16. The apparatus according to be claim 9, wherein said charging width W is determined to at least 25 mm.

17. A screen drum type electrographic apparatus comprising a drum type screen photosensitive body rotatable at a constant speed, and a flat-shaped record medium opposed to said screen photosensitive body and fed along a rectilinear passage at a constant speed, whereby a flow of ions is modulated by an electrostatic latent image produced on said screen photosensitive body to form a picture image on said record medium, characterized in that a ratio of a feeding speed of said record medium to a peripheral speed of said screen drum is selected to 1.026 under conditions that a radius of said screen drum is 102 mm, the shortest distance between said screen drum and said record medium is 4.8 mm and the corona charging width is 40 mm.

18. A screen drum type electrographic apparatus comprising a drum type screen photosensitive body rotatable at a constant speed, and a flat-shaped record medium opposed to said screen photosensitive body and fed along a rectilinear passage at a constant speed, whereby a flow of ions is modulated by an electrostatic latent image produced on said screen photosensitive body to form a picture image on said record medium, the improvement comprising in that a ratio of a feeding speed of said record medium to a peripheral speed of said screen drum is selected to 1.027 under conditions that a radius of said screen drum is 102 mm, the shortest distance between said screen drum and said record medium is 4.8 mm and the corona charging width is 50 mm.

19. A screen drum type electrographic apparatus comprising a drum type screen photosensitive body rotatable at a constant speed, and a flat-shaped record medium opposed to said screen photosensitive body and fed along a rectilinear passage at a constant speed, whereby a flow of ions is modulated by an electrostatic latent image produced on said screen photosensitive body to form a picture image on said record medium, the improvement comprising in that a ratio of a feeding speed of said record medium to a peripheral speed of said screen drum is selected to 1.024 under conditions that a radius of said screen drum is 102 mm, the shortest distance between said screen drum and said record medium is 4.8 and the corona charging width is 20 mm.

20. A screen drum type electrographic apparatus comprising a drum type screen photosensitive body rotatable at a constant speed, and a flat-shaped record medium opposed to said screen photosensitive body and fed along a rectilinear passage at a constant speed, whereby a flow of ions is modulated by an electrostatic latent image produced on said screen photosensitive body to form a picture image on said record medium, the improvement comprising in that a ratio of a feeding speed of said record medium to a peripheral speed of said screen drum is selected to 1.025 under conditions that a radius of said screen drum is 102 mm, the shortest distance between said screen drum and said record medium is 4.8 mm and the corona charging width is 30 mm.

* * * * *